US007326891B2

(12) United States Patent
Sung et al.

(10) Patent No.: US 7,326,891 B2
(45) Date of Patent: Feb. 5, 2008

(54) STEAM GENERATION APPARATUS USING INDUCTION HEATING AND OVEN INCLUDING THE SAME

(75) Inventors: Han Jun Sung, Suwon-si (KR); Dae Sung Han, Hwasung-si (KR); Yong Hyun Kwon, Suwon-si (KR); Chul Kim, Yongin-si (KR); Tae Uk Lee, Suwon-si (KR); Seong Deog Jang, Suwon-Si (KR); Han Seong Kang, Hwasung-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 62 days.

(21) Appl. No.: 11/385,720

(22) Filed: Mar. 22, 2006

(65) Prior Publication Data

US 2006/0278630 A1 Dec. 14, 2006

(30) Foreign Application Priority Data

Jun. 8, 2005 (KR) ..... 10-2005-0048977
Jun. 8, 2005 (KR) ..... 10-2005-0048998

(51) Int. Cl.
*H05B 6/10* (2006.01)

(52) U.S. Cl. ..... 219/629; 219/630; 122/227; 392/405

(58) Field of Classification Search ..... 219/628–630, 219/682, 401; 122/227–228, 4 A, 233–234; 392/405–406
See application file for complete search history.

(56) References Cited

U.S. PATENT DOCUMENTS 5,286,942 A 2/1994 McFadden et al.
6,584,985 B2 * 7/2003 Omura ..... 132/272

(Continued)

FOREIGN PATENT DOCUMENTS

EP 0 580 899 A1 2/1994

(Continued)

OTHER PUBLICATIONS

Extended European Search Report issued by the European Patent Office on May 15, 2007 in Application No. 06006310.4—2301 (5 pages).

(Continued)

*Primary Examiner*—Philip H. Leung
(74) *Attorney, Agent, or Firm*—Staas & Halsey LLP

(57) ABSTRACT

A steam generating apparatus, and an oven including the same. The apparatus includes a water tank adapted to enable convenient cleaning, and is adapted to heat water in the water tank via an induction heating method to generate steam rapidly. The water tank is provided with a steam discharging pipe. The apparatus further includes an induction coil assembly, an induction heating member fitted to the water tank such that it is located near the induction coil assembly, a barrier inserted into the water tank such that only a small amount of water is directly heated by the induction heating member which generates heat by the induction coil assembly, and a cover closing an upper portion of the water tank. The steam discharging pipe is connected with a steam supplying pipe which communicates a cavity with a cooking compartment to supply steam from the apparatus to the cooking compartment.

13 Claims, 10 Drawing Sheets

U.S. PATENT DOCUMENTS

2002/0153369 A1* 10/2002 Uemura ..... 219/628

FOREIGN PATENT DOCUMENTS

| | | |
|---|---|---|
| EP | 0 653 900 A1 | 5/1995 |
| JP | 4-123790 | 4/1992 |
| JP | 9-4803 | 1/1997 |
| JP | 9-196302 | 7/1997 |
| JP | 2003-52538 | 2/2003 |
| KR | 10-707702 | 12/1997 |

OTHER PUBLICATIONS

Official Action issued by the Russian Patent Office in Application No. 2006110114(011001) (4 pages) (2 pages of English translation).

* cited by examiner

STEAM GENERATION APPARATUS USING INDUCTION HEATING AND OVEN INCLUDING THE SAME

CROSS-REFERENCE TO RELATED APPLICATIONS

This application claims the benefit of Korean Patent Application Nos. 10-2005-0048977 and 10-2005-0048998, both filed on Jun. 8, 2005 in the Korean Intellectual Property Office, the disclosure of which is incorporated herein by reference.

BACKGROUND OF THE INVENTION

1. Field of the Invention

The present invention relates to a steam generating apparatus, and an oven including the same. More particularly, the present invention relates to a steam generating apparatus, which includes a water tank adapted to enable convenient cleaning, and is configured to heat water in the water tank via an induction heating method in order to generate steam rapidly, and an oven including the same.

2. Description of the Related Art

A steam generating apparatus is an apparatus which generates steam by heating water contained in a water tank, and is installed in an oven to help cooking. Specifically, when the apparatus generates high temperature steam in the oven during cooking, the steam is uniformly delivered to food in the oven so that the food is cooked without being burnt or being partially undercooked while containing a suitable amount of moisture. As a result, the food can be prepared in a moist state after being cooked. In addition, the steam serves to take fats and salts away from the food during cooking, so that the food has a low calorie and low salinity after being cooked, and is beneficial for health and diet.

Generally, a conventional steam generating apparatus includes a water tank, and an electric heater positioned in the water tank to generate steam by heating water in the water tank to which a predetermined amount of water is supplied through a water supply pipe or from a separate water reservoir. In the conventional steam generating apparatus with the electric heater installed in the water reservoir, scales are created due to mineral components such as calcium and magnesium contained in water of the water tank, and attached to an inner wall of the water tank, deteriorating performance of the electric heater while contaminating the steam.

Accordingly, it is necessary to clean the interior of the water tank periodically in order to remove the scales. However, since the electric heater is positioned in the water tank, making the structure of the conventional steam generating apparatus complicated, the conventional steam generating apparatus has a disadvantage in that it is difficult to clean the water tank conveniently and satisfactorily.

PCT International Publication WO 96/131138 discloses a steam generating apparatus which employs an induction heating method. The steam generating apparatus includes a water tank, an induction coil assembly positioned outside the water tank, and an induction heating member positioned inside the water tank such that, when electric current is applied to the induction coil assembly, induction current is induced in the induction heating member, and thus the induction heating member generates heat, thereby heating water in the water tank to generate steam.

The steam generating apparatus of the disclosure has a structure wherein the induction coil assembly and the porous heating member are respectively positioned at an outer portion and an inner portion of a heating chamber, i.e., the water tank, or a structure wherein both induction coil assembly and porous heating member are positioned in the heating chamber. With this structure, when electric current is applied to the induction coil assembly, induction current is induced in the porous heating member, and thus porous heating member generates heat, so that water in the water tank is heated, and is converted to steam.

However, since the steam generating apparatus of the disclosure has the structure to generate steam by heating all water in the heating chamber, it has disadvantages in that it cannot rapidly generate the steam, and requires large power consumption.

In addition, according to the disclosure, the heating chamber is fixed to a water supply pipe or a separate water supplying tank to supply water supplied from the outside to the heating chamber, and the porous heating member cannot be easily separated from the heating chamber, so that the heating chamber cannot be easily cleaned, making it difficult to remove the scales attached to the inner wall of the heating chamber, and the porous heating member.

SUMMARY OF THE INVENTION

Accordingly, it is an aspect of the present invention to provide a steam generating apparatus, which includes a water tank adapted to enable convenient and easy cleaning and is configured to heat some water in the water tank via an induction heating method in order to rapidly generate steam, and an oven including the same.

Additional aspects and/or advantages of the invention will be set forth in part in the description which follows and, in part, will be apparent from the description, or may be learned by practice of the invention.

In accordance with one aspect of the present invention, there is provided a steam generating apparatus, including: a water tank opened at an upper portion; a cover closing the upper portion of the water tank; a barrier positioned inside the water tank to partition an interior of the water tank into a water supplying part and a steam generating part; at least one induction coil assembly positioned outside the water tank; and an induction heating member positioned between the barrier and the induction coil assembly within the water tank, and induction-heated by the induction coil assembly to allow the steam generating part to generate steam.

The induction coil assembly may be positioned at an outer portion of one side of the water tank, the barrier may be positioned vertically adjacent the induction coil assembly such that the steam generating part has a much smaller volume than the water supplying part, and the induction heating member may be vertically positioned between the one side of the water tank and the barrier.

The barrier may have a lower end abutting a bottom surface of the water tank, and an upper end separated a predetermined distance from a top surface of the water tank, the water tank being formed at the top surface with a steam discharging pipe through which the steam generated from the steam generating part is discharged.

The lower end of the barrier may be formed with at least one communication hole through which water is supplemented from the water supplying part to the steam generating part as the steam is generated in the steam generating part.

The barrier may be made from a material having a lower conductivity, and the water tank may have first guide grooves formed on front and rear sides thereof such that opposite ends of the barrier are slid along the first guide grooves, and engaged with or disengaged from the water tank.

The induction heating member may be made from a material having a higher conductivity, and the water tank may have second guide grooves formed inside the first guide grooves on the front and rear sides thereof, respectively, such that opposite ends of the induction heating member are slid along the second guide grooves, and engaged with or disengaged from the water tank.

The steam generating apparatus may further include a supporting member to fix the induction coil assembly.

The at least one induction coil assembly may include a plurality of induction coil assemblies positioned up and down on the supporting member.

The induction coil assembly and the induction heating member may have profiles extending from the bottom surface to an intermediate portion of the water tank, respectively.

The induction coil assembly may be positioned at an outer portion of a bottom surface of the water tank, the barrier may be positioned horizontally on the bottom surface of the water tank while being adjacent to the induction coil assembly such that the steam generating part has a much smaller volume than the water supplying part, and the induction heating member may be horizontally positioned between the bottom surface of the water tank and the barrier.

The water tank may be provided at an upper portion with a steam discharging pipe, and the barrier may include a horizontal section extending in parallel with the bottom surface of the water tank, and a slanted section extending from the horizontal section towards the steam discharging pipe.

The horizontal section may be formed with a plurality of through-holes through which water is supplied from the water supplying part to the steam generating part to supplement reduction of water in the steam generating part as the water is converted to steam in the steam generating part.

The barrier and the induction heating member may be supported by supporting protrusions positioned at respective corners of the water tank.

In accordance with another aspect of the present invention, there is provided an oven, including a cooking compartment, a cavity partitioned from the cooking compartment, a steam generating apparatus inserted in the cavity, and a steam supplying pipe connecting a rear portion of the cavity with a side of the cooking compartment, wherein the steam generating apparatus includes: a water tank opened at an upper portion; a cover closing the upper portion of the water tank; a barrier positioned inside the water tank to partition an interior of the water tank into a water supplying part and a steam generating part; at least one induction coil assembly positioned outside the water tank; and an induction heating member positioned between the barrier and the induction coil assembly within the water tank, and induction-heated by the induction coil assembly to allow the steam generating part to generate steam, the water tank being provided at a rear upper portion thereof with a steam discharging pipe to which the steam supplying pipe is inserted to supply steam to the cooking compartment through the steam discharging pipe.

The water tank may have a handle formed on a front side such that, when the water tank is pushed into the cavity using the handle, the steam discharging pipe is connected with the steam supplying pipe, allowing the water tank to be installed in the cavity, and such that, when the water tank is pulled out of the cavity using the handle, the steam discharging pipe is disengaged from the steam supplying pipe, allowing the water tank to be separated from the cavity.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Reference will now be made in detail to the embodiments of the present invention, examples of which are illustrated in the accompanying drawings. The embodiments are described below to explain the present invention by referring to the figures.

Figure 1:
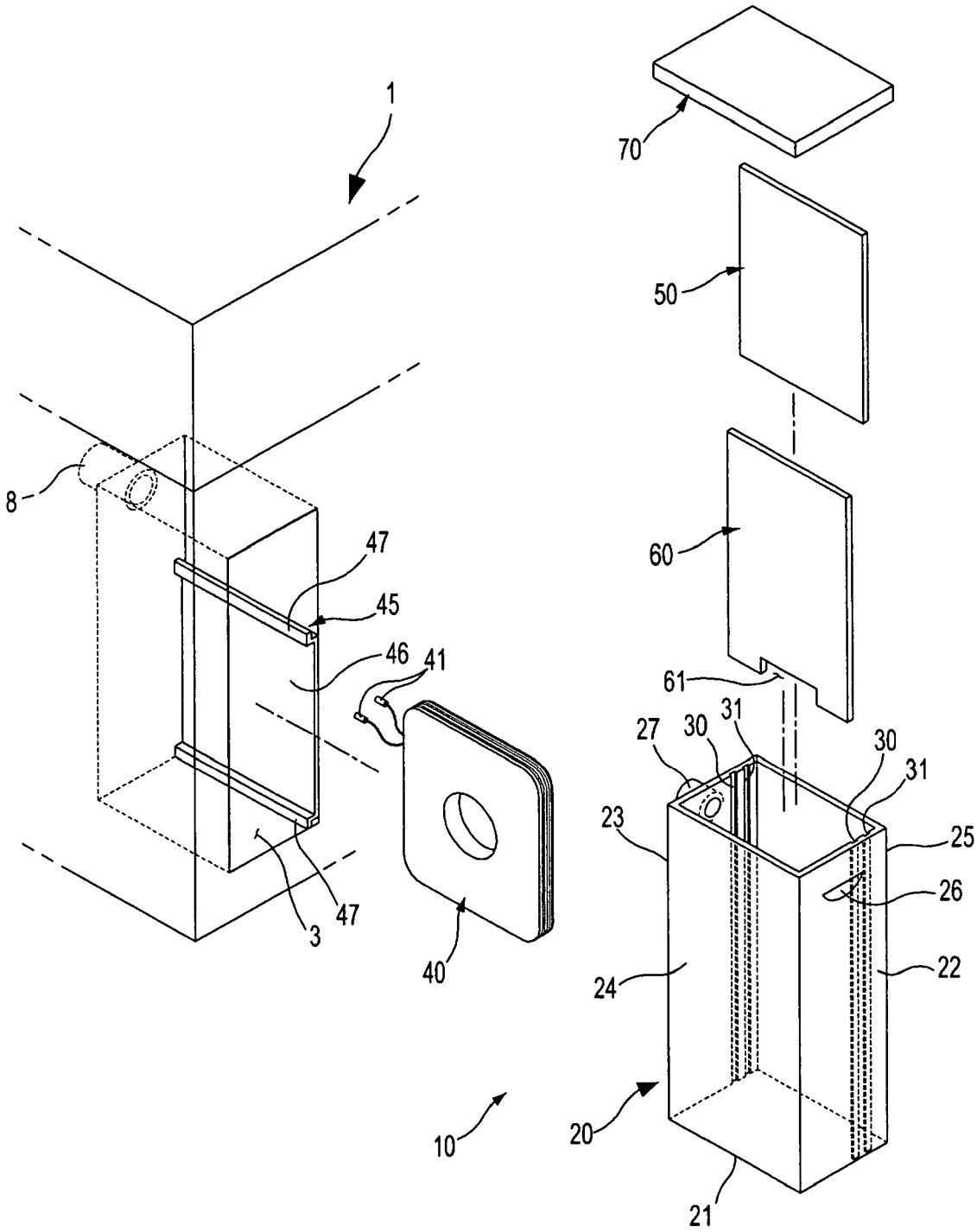
FIG. 1 is an exploded perspective view illustrating a steam generating apparatus in accordance with a first embodiment of the present invention.
Figure 2:
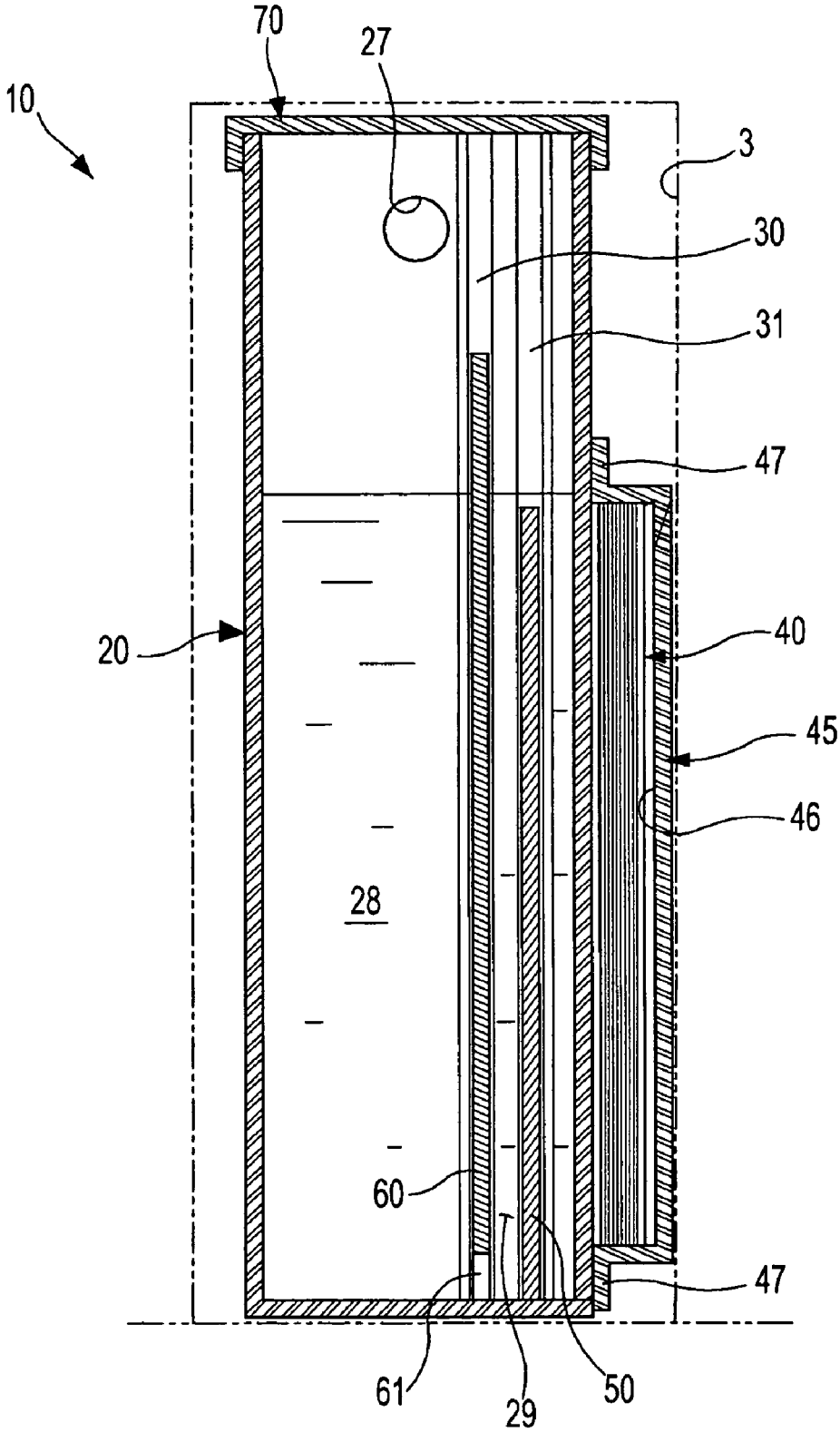
FIG. 2 is a cross-sectional view of the steam generating apparatus of FIG. 1 in an assembled state.

FIG. 1 is an exploded perspective view illustrating a steam generating apparatus in accordance with a first embodiment of the present invention, and FIG. 2 is a cross-sectional view of the assembled steam generating apparatus of FIG. 1.

As shown in FIGS. 1 and 2, a steam generating apparatus 10 of the invention includes a water tank 20 opened at an upper portion to receive a predetermined amount of water for generation of steam, at least one induction coil assembly 40 and an induction heating member 50 positioned outside and inside the water tank 20 respectively to heat the water and generate steam in the water tank 20, a barrier 60 positioned within the water tank 20 so as to allow only a portion of water in the water tank 20 to be directly heated by the induction heating member 50 while guiding the steam to an upper portion of the water tank 20, a cover 70 closing the open upper portion of the water tank 20, and a supporting member 45 to support the induction coil assembly 40.

The water tank 20 includes a bottom surface 21, front and rear sides 22 and 23, and left and right sides 24 and 25 to have a box shape opened at an upper portion. The water tank 20 has a handle 26 depressed at an upper portion from the front side 22, and a steam discharging pipe 27 positioned at an upper end of the rear side to discharge steam generated in the water tank 20 to an outside.

The supporting member 45 includes a base plate 46 to which the induction coil assembly 40 is coupled and supported thereby, and a pair of guide rails 47 to guide the water tank 20 to engage with or disengage from a cavity 3 which is partitioned from a cooking compartment 2 (see FIG. 3) in an oven 1.

The base plate 46 is a planar plate which has dimensions to allow the induction coil assembly 40 to be positioned thereon. The base plate 46 is vertically coupled to one side of the cavity 3 by means of bolts, or welded thereto. The pair of guide rails 47 protrude at upper and lower ends of the base plate 47 to a height slightly greater than or equal to the thickness of the induction coil assembly 40 while extending in a front and rear direction of the cavity 3.

The induction coil assembly 40 has a thin plate shape in which a coil is wound around a bobbin having a hole formed at a center thereof, and includes a pair of terminals 41 connected to a power source (not shown) positioned at a rear side of the cavity 3 to receive electric current from the power source. The induction coil assembly 40 is bonded to the base plate 46 of the supporting member 45 by means of a bonding agent such as silicone, or fastened thereto by screws.

The barrier 60 has a plate shape, and is vertically positioned near one side of the water tank 20 (in the first embodiment, near the right side 25 of the water tank 20) to partition the interior of the water tank 20 into a water supplying part 28 having a much greater volume and a steam generating part 29 having a much smaller volume.

The barrier 60 has a height to allow the upper end of the barrier 60 to be located below the steam discharging pipe 27 of the water tank 20 when the barrier 60 is fitted to the water tank 20 so that steam is guided upward by the barrier 60, and efficiently moved towards the steam discharging pipe 27.

The water tank 20 has first guide grooves 30 formed on the front and rear sides 22 and 23 with a width of the same size as the thickness of the barrier 60, respectively, such that the barrier 60 is fitted to and slid along the first grooves 30. With this structure, the barrier 60 is conveniently engaged with or disengaged from the water tank 20.

The barrier 60 is formed at the lower end with a communication hole 61 extending in the longitudinal direction to communicate the water supplying part 28 with the steam generating part 29. Thus, when an amount of water is reduced in the steam generating part 29 defined between the barrier 60 and the right side 25 of the water tank 20 due to conversion of water into steam, the water moves from the water supplying part 28 to the steam generating part 29 through the communication hole 61, and supplements reduction of the water in the steam generating part 29.

As such, the communication hole 61 formed at the lower end of the barrier 60 prevents the water heated to a high temperature in the steam generating part 29 from moving into the water supplying part 28, while allowing the water having a low temperature in the water supplying part 28 to move into the steam generating part 29 easily.

The induction heating member 50 has a plate shape, and is positioned very close to the right side 25 of the water tank 20 within the water tank 20. Thus, when applying electric current to the induction coil assembly 40 positioned outside the right side 25 of the water tank 20, induction current is induced in the induction heating member 50, and thus the induction heating member 50 generates heat.

As such, the water contained in the steam generating part 29 is heated by thermal energy from the induction heating member 50, and is converted into steam.

The water tank 20 has second guide grooves 31 formed in a vertical direction inside the first guide grooves 30 on the front and rear sides 22 and 23, respectively, such that the induction heating member 50 is slid along the second guide grooves 31, and is easily engaged with or disengaged from the water tank 20.

The induction heating member 50 may be made of a highly conductive metallic material, and the barrier 60 may be made of a non-metallic material having low conductivity and good thermal resistance. Accordingly, heat emitted from the induction heating member 50 is efficiently transferred to a small amount of water located between the barrier 60 and the right side 25 of the water tank 20, so that steam is rapidly generated.

The barrier 60 may also be made of a metallic material such as stainless steel in order to allow easy cleaning of the barrier 60.

In order to allow a small amount of water to be given sufficient thermal energy by the induction heating member 50, it is desirable that a distance between the barrier 60 and the right side 25 of the water tank 20 be as narrow as possible to allow only a small amount of water to be received in the steam generating part 29.

Although the distance between the barrier 60 and the induction heating member 50 positioned adjacent the right side 25 of the water tank 20 may be as narrow as possible, the distance is suggested to be greater than 5~10 mm, which is a size of a bubble generated in the steam generating part 29.

The cover 70 is made from a material which enables the cover 70 to be easily coupled to or separated from the open upper portion of the water tank 20 while closing the upper portion of the water tank 20. Thus, when the cover 70 is fitted to the upper portion of the water tank 20, steam is prevented from leaking through an edge of the cover 70 and the water tank 20. The cover 70 can be easily separated from the water tank 20 by pulling the cover 70 up.

Then, the induction heating member 50 and the barrier 60 are easily and rapidly assembled to the water tank 20 by sliding the induction heating member 50 and the barrier 60 along the first and second guide grooves 30 and 31 until the induction heating member 50 and the barrier 60 are fitted to the water tank 20, and by coupling the cover 70 to the upper portion of the water tank 20.

When the water tank 20 having the induction heating member 50 and the barrier 60 coupled thereto is pushed into the cavity 3 of the oven 1 in which the induction coil assembly 40 is installed along with the supporting member 45 supporting the induction coil assembly 40, the right side 25 of the water tank 20 is guided along the guide rails 47 of the supporting member 45, and slid inside the cavity 3.

When the water tank 20 is inserted in the cavity 3, the steam discharging pipe 27 positioned at the rear side 23 of the water tank 20 is fitted to an entrance of a steam supplying pipe 8 positioned at the rear side of the cavity 3, so that installation of the steam generating apparatus 10 to the oven is conveniently finished.

When electric current is applied to the induction coil assembly 40 after the steam generating apparatus 10 is assembled to the oven, induction current is induced in the induction heating member 50 by virtue of electromagnetic induction, and thus the induction heating member 50 generates heat, so that water in the steam generating part 29 is heated, and converted into steam.

Figure 4:
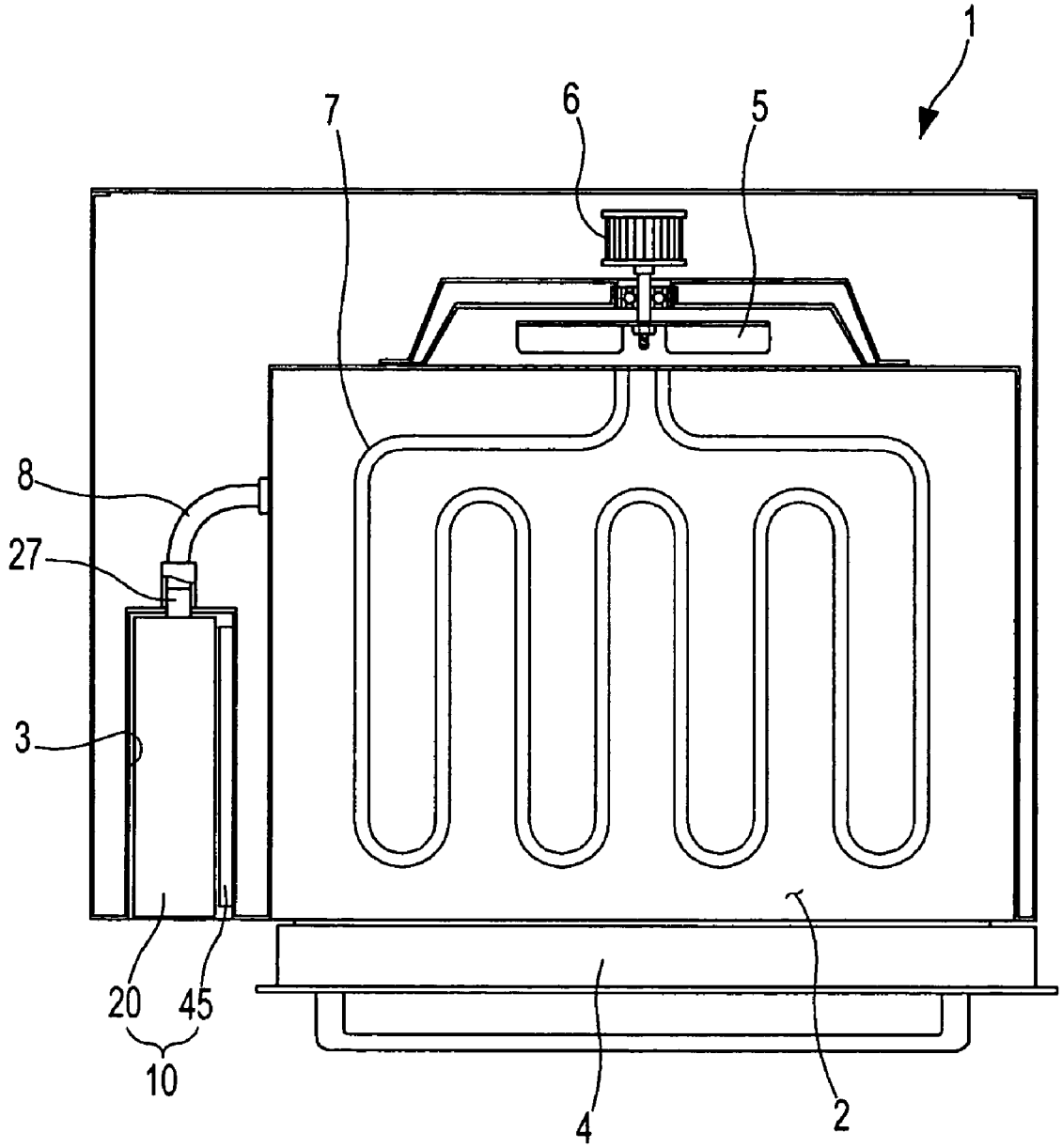
FIG. 4 is a cross-sectional view taken along line IV-IV of FIG. 3.

The steam generated from the steam generating part 29 is raised to the upper portion of the water tank 20 with guidance of the barrier 60, discharged through the steam discharging pipe 27, and finally supplied to the cooking compartment 2 of the oven 1 through the steam supplying pipe 8 (see FIG. 4).

If scale is created inside the water tank 20 due to long term use of the steam generating apparatus 10, the water tank 20 can be cleaned after disassembling the cover 70, the barrier 60, and the induction heating member 50 from the water tank 20 in a sequence reverse to the assembling sequence as described above, so that the scale can be easily removed from the tank 20.

Operation of the steam generating apparatus 10 according to the first embodiment installed in the oven 1 will be described with reference to FIGS. 3 and 4.

Figure 3:
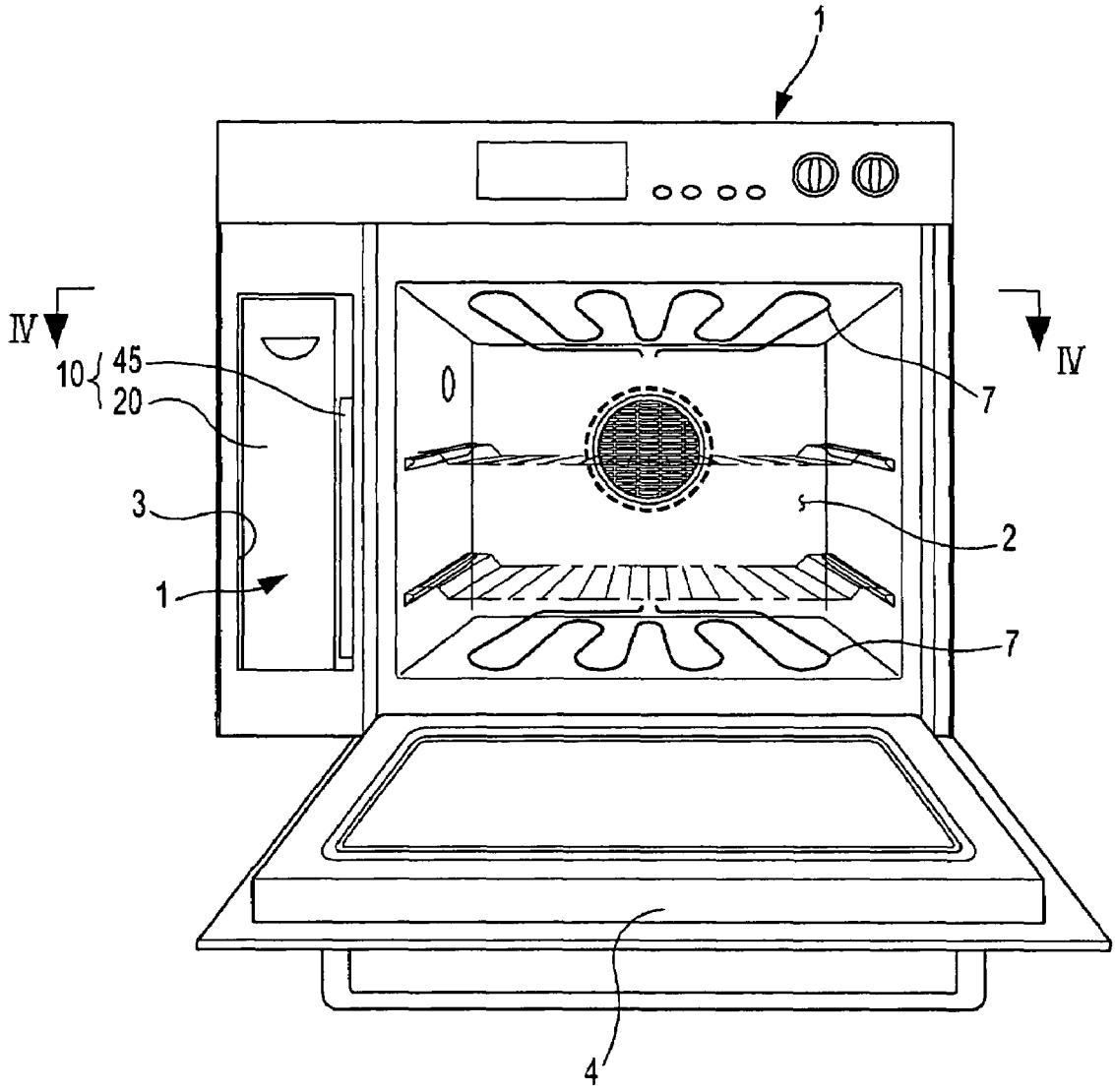
FIG. 3 is a front view illustrating an oven having the steam generating apparatus in accordance with the first embodiment of the present invention.

FIG. 3 is a front view illustrating an oven having the steam generating apparatus in accordance with the first embodiment of the present invention, and FIG. 4 is a cross-sectional view taken along line IV-IV of FIG. 3.

As shown in FIGS. 3 and 4, the oven 1 includes the cooking compartment 2 opened at a front side, the cavity 3 partitioned from the cooking compartment 2, and a door 4 attached to the front side of the cooking compartment 2.

The cavity 3 is installed with the steam generating apparatus 10 by inserting the steam generating apparatus 10 thereinto, and the cooking compartment 2 is provided at a rear side with a convection fan 5 and a fan motor 6 to circulate hot air and steam such that the hot air and the steam are distributed in an overall space of the cooking compartment 2.

The cooking compartment 2 is provided with electric heaters 7 on top and bottom surfaces to prevent the steam from being condensed on the top and bottom surfaces of the cooking compartment 2 while heating the steam supplied from the steam generating apparatus 10 and interior air in the cooking compartment 2 to high temperatures. If the top surface and the bottom surface of the cooking compartment 2 themselves are constituted by surface heaters instead of the electric heaters 7, the surface heaters also can have the same function as that of the electric heaters 7.

The steam generating apparatus 10 is installed in the cavity 3 by fixing the base plate 46 of the supporting member 45 to the right side of the cavity 3 such that the induction coil assembly 40 is fixed to the cavity 3, and then sliding the water tank 20 into the cavity 3 along the pair of guide rails 47 of the supporting member 45.

Meanwhile, when pulling the handle 26 in a state that the water tank 20 is inserted in the cavity 3, the water tank 20 can be conveniently pulled out of the cavity 3, and then cleaned as described above or filled with water.

When the water tank 20 is coupled to the cavity 3, the steam discharging pipe 27 of the water tank 20 is automatically fitted to the steam supplying pipe 8 which extends from the rear side of the cavity 3 to a left side of the cooking compartment 2. In this state, as the steam generating apparatus 10 is operated, steam generated in the water tank 20 is supplied to the cooking compartment 2 through the steam discharging pipe 27 and the steam supplying pipe 8.

The steam supplied to the cooking compartment 2 is increased in temperature, and distributed in the overall space of the cooking compartment 2 by operation of the convection fan 5 and the electric heater 7, so that food is cooked by the steam.

Figure 5:
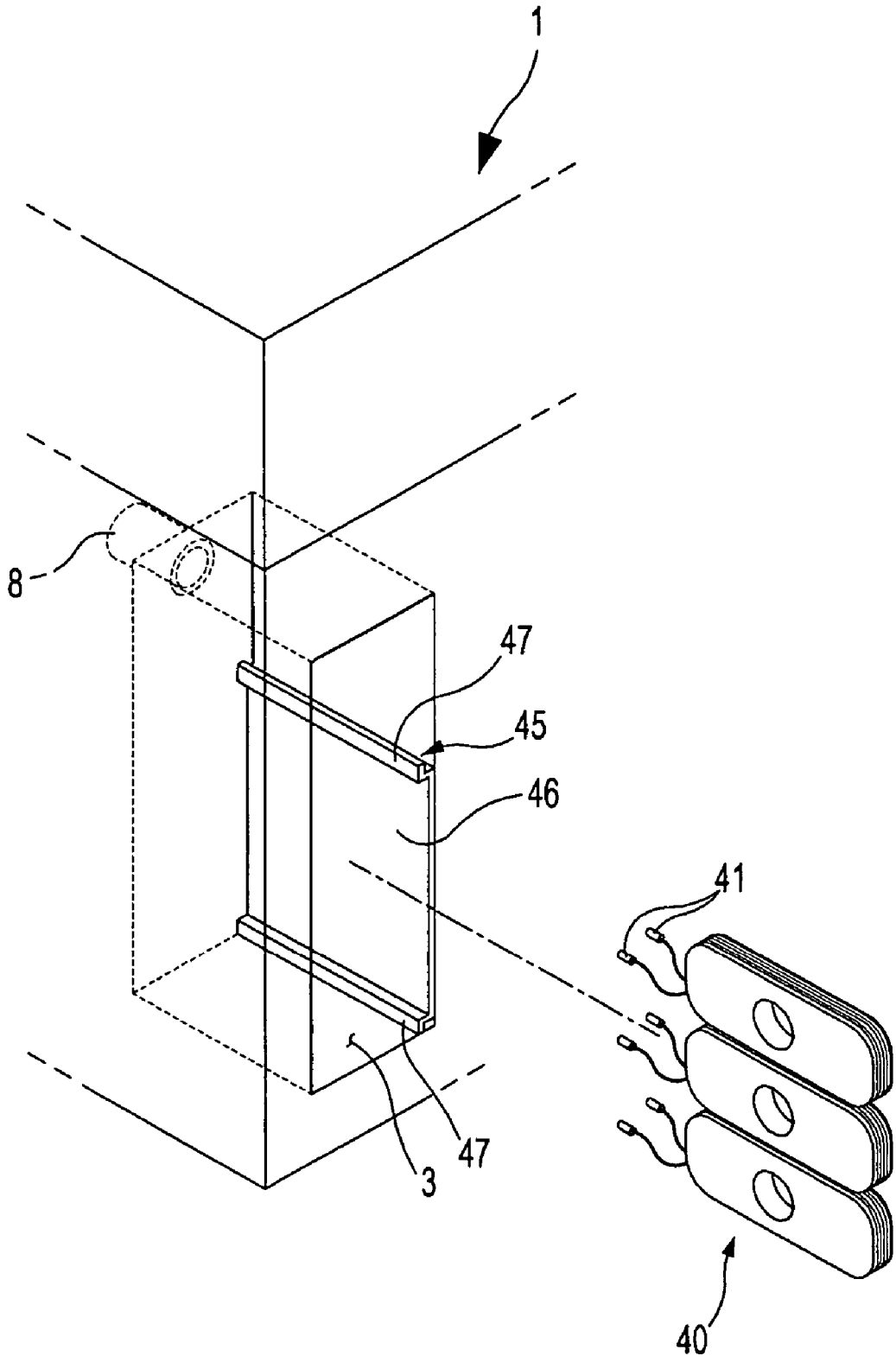
FIG. 5 is a view illustrating an induction coil assembly having a different configuration from that of the induction coil assembly shown in FIG. 1.

FIG. 5 shows induction coil assemblies having a different configuration from that of the induction coil assembly shown in FIG. 1. As shown in FIG. 5, a plurality of induction coil assemblies 40 are provided, and each induction coil assembly 40 has a low profile such that the induction coil assemblies 40 are arranged in a vertical direction on the base plate 46 of the supporting member 45, so that output of the induction coil assemblies 40 can be easily controlled.

Specifically, the induction coil assemblies 40 can be controlled as follows. When a level of water in the water tank 20 is high, a maximum amount of thermal energy is generated from the induction coil assemblies 40 by applying electric current to all induction coil assemblies 40. When the level of water in the water tank 20 is medium, a medium amount of thermal energy is generated from the induction coil assemblies 40 by cutting off electric current applied to the uppermost induction coil assembly 40. When the level of water in the water tank 20 is low, a low amount of thermal energy is generated from the induction coil assemblies 40 by applying electric current only to the lowermost induction coil assembly 40.

Figure 6:
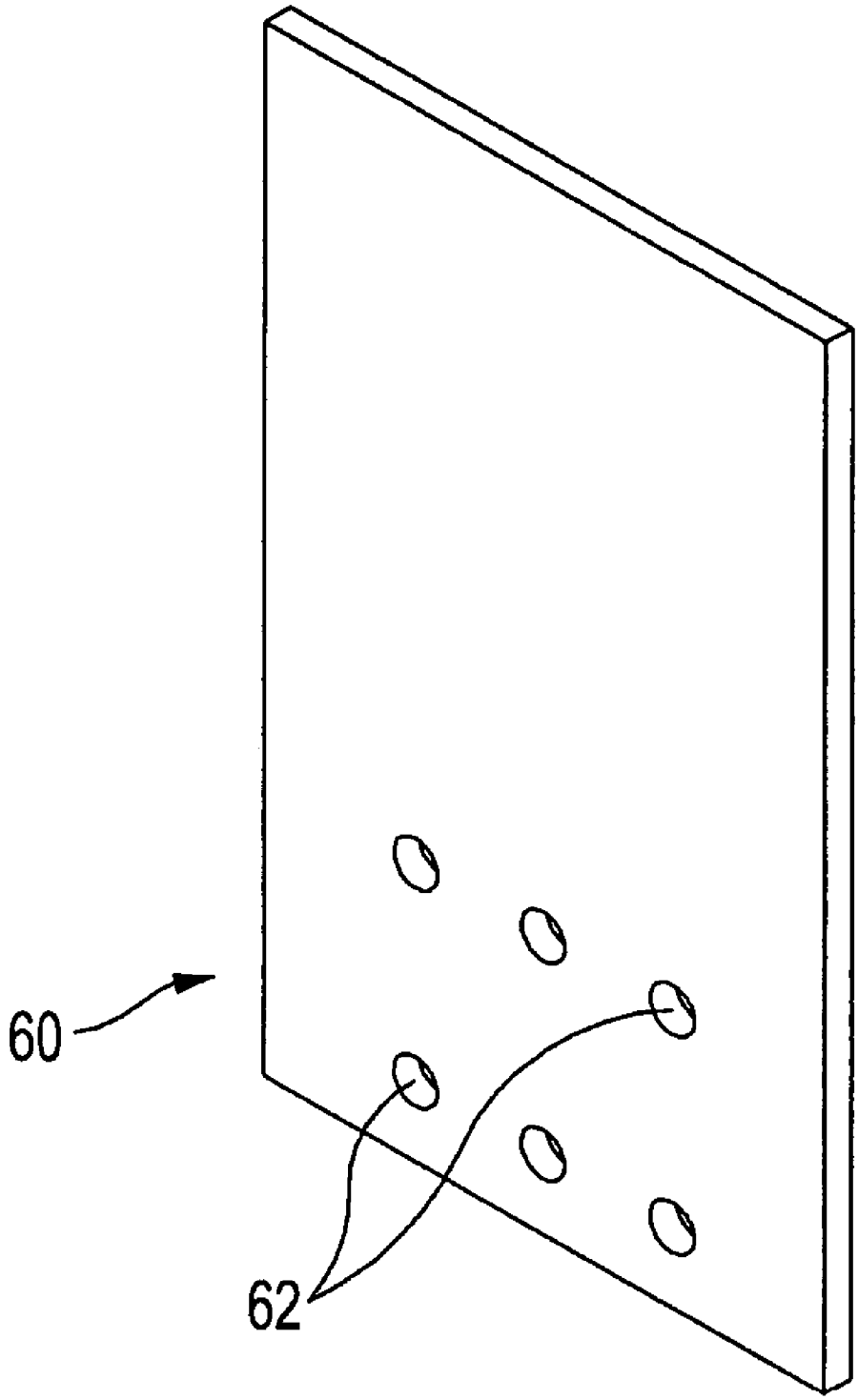
FIG. 6 is a view illustrating a barrier having a different configuration from that of the barrier shown in FIG. 1.

FIG. 6 shows a barrier having a different configuration from that of the barrier shown in FIG. 1. As shown in FIG. 6, the barrier 60 has a structure wherein a plurality of small circular communication holes 62 are formed at a lower portion of the barrier 60 instead of the structure wherein the communication hole 61 extends in the longitudinal direction at the lower end of the barrier 60. With this structure, water can be supplemented from the water supplying part 28 to the steam generating part 29.

Here, in order to effectively prevent water heated in the steam generating part 29 from moving towards the water supplying part 28, it is desirable that each of the communication holes 62 have a diameter of about 5 mm, and that an area ratio of the overall communication holes 62 to the barrier 60 be small.

Next, a steam generating apparatus according to a second embodiment, and an oven including the same will be described with reference to FIGS. 7 through 10.

Figure 7:
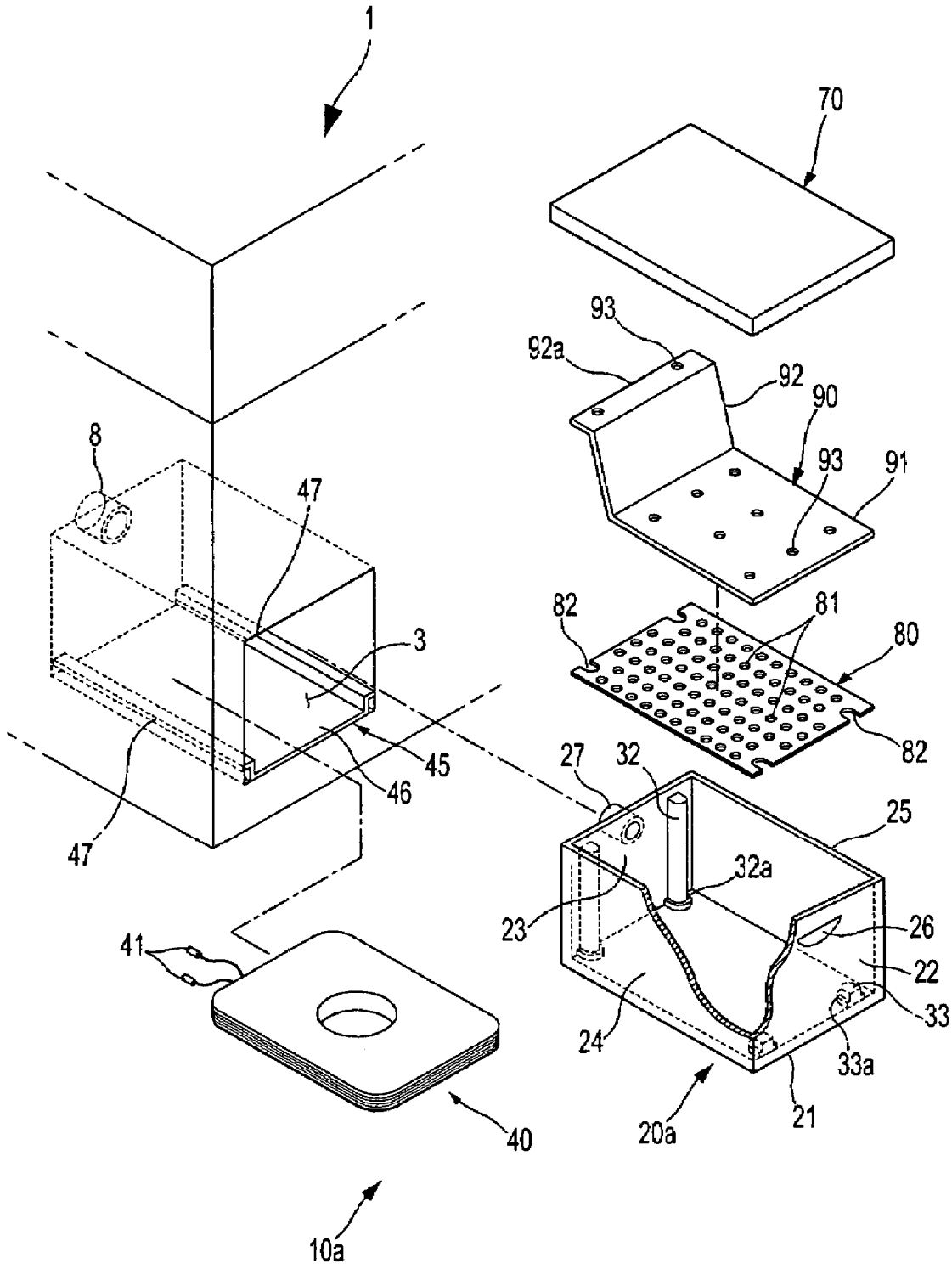
FIG. 7 is an exploded perspective view illustrating a steam generating apparatus in accordance with a second embodiment of the present invention.
Figure 8:
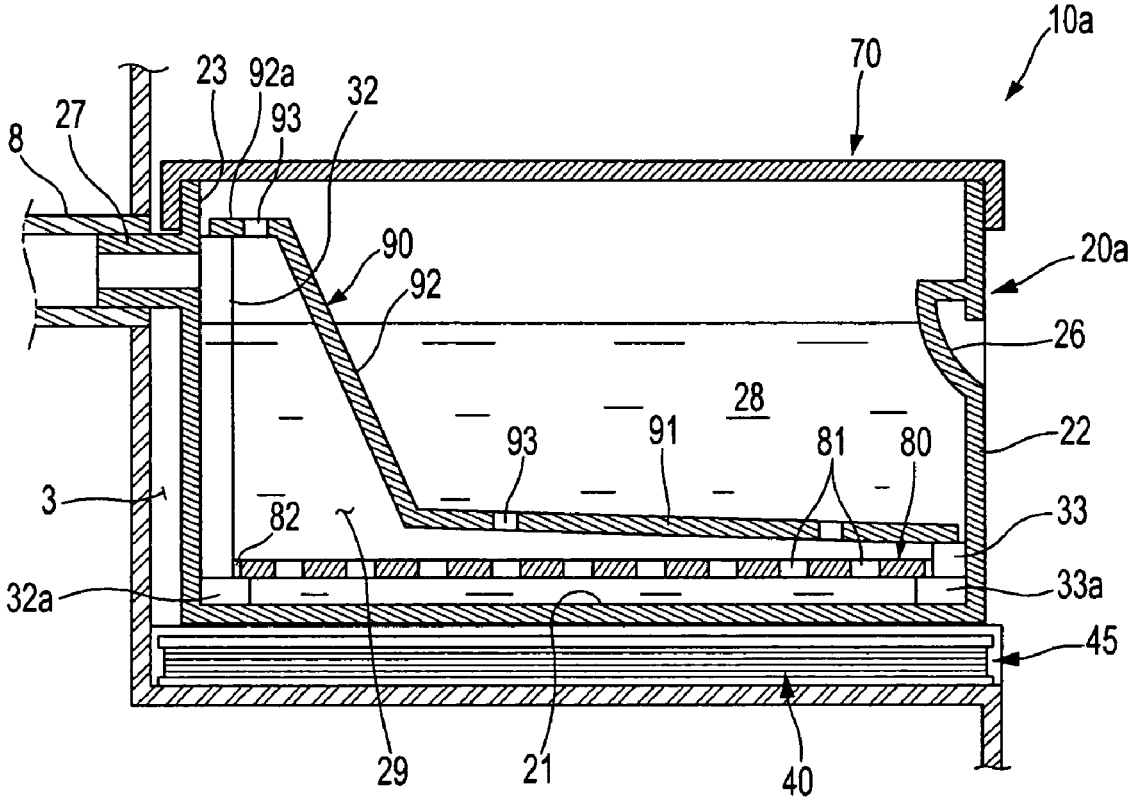
FIG. 8 is a cross-sectional view of the steam generating apparatus of FIG. 7 in an assembled state.

FIG. 7 is an exploded perspective view illustrating the steam generating apparatus of the second embodiment, and FIG. 8 is a cross-sectional view of the assembled steam generating apparatus of FIG. 7.

As shown in FIGS. 7 and 8, a steam generating apparatus 10*a* of the second embodiment includes a water tank 20*a* opened at an upper portion to receive a predetermined amount of water for generation of steam, an induction coil assembly 40 and an induction heating member 80 positioned outside and inside the water tank 20*a* respectively to heat the water in the water tank 20*a* and generate steam, a barrier 90 positioned within the water tank 20*a* so as to allow only a portion of water in the water tank 20*a* to be directly heated by the induction heating member 80 while guiding the steam to an upper portion of the water tank 20*a*, a cover 70 closing the open upper portion of the water tank 20*a*, and a supporting member 45 to support the induction coil assembly 40.

The water tank 20*a* includes a bottom surface 21, front and rear sides 22 and 23, and left and right sides 24 and 25 to have a box shape opened at an upper portion. The water tank 20*a* has a handle 26 depressed at an upper portion from the front side 22, and a steam discharging pipe 27 positioned at an upper end of the rear side to discharge steam generated in the water tank 20*a* to an outside of the water tank 20*a*.

The supporting member 45 includes a base plate 46 to which the induction coil assembly 40 is coupled and supported thereby, and a pair of guide rails 47 to guide the water tank 20*a* to engage with or disengage from a cavity 3 which is partitioned from a cooking compartment 2 (see FIG. 9) in an oven 1.

The base plate 46 is a planar plate which has dimensions to allow the induction coil assembly 40 to be positioned thereon. The base plate 46 is horizontally coupled to the bottom of the cavity 3 by means of bolts, or welded thereto. The pair of guide rails 47 protrude at left and right ends of the base plate 47 to a height slightly greater than or equal to the thickness of the induction coil assembly 40 while extending in a front and rear direction of the cavity 3.

The induction coil assembly 40 has a thin plate shape in which a coil is wound around a bobbin having a hole formed at a center thereof, and includes a pair of terminals 41 connected to a power source (not shown) positioned at a rear side of the cavity 3 to receive electric current from the power source. The induction coil assembly 40 is bonded to the base plate 46 of the supporting member 45 by means of a bonding agent such as silicone, or fastened thereto by means of screws.

The barrier 90 has a thin plate shape. The barrier 90 includes a horizontal section 91 separated a predetermined distance from the bottom surface 21 of the water tank 20*a* within the water tank 20*a*, and a slanted section 92 which is integrally formed with the horizontal section 91 and extends upward from a rear end of the horizontal section 91. The barrier 90 divides the interior of the water tank 20*a* into a water supplying part 28 having a much greater volume and a steam generating part 29 having a much smaller volume.

An upper end 92*a* of the slanted section 92 extends horizontally a small distance towards the rear side 23 of the water tank 20, and is located above the steam discharging pipe 27 so that steam generated in the steam generating part 29 is efficiently moved into the steam discharging pipe 27 along the barrier 90.

The horizontal section 91 of the barrier 90 is formed with a plurality of small communication holes 93 through which water is supplied from the water supplying part 28 to the steam generating part 29 when the water in the steam generating part 29 is converted to steam, and discharged to the steam discharging pipe 27.

In addition, the upper end 92*a* of the slanted section 92 of the barrier 90 is also formed with communication holes 93 to communicate the water supplying part 28 with an upper portion of the steam generating part 29 so that steam remaining at the upper portion of the water supplying part 28 can be moved into the steam discharging pipe 27.

The induction heating member 80 has a plate shape. The induction heating member 80 is horizontally disposed in the water tank 20*a* while being separated from the bottom surface 21 of the water tank 20*a* to define a gap with respect to the bottom surface 21. When electric current is applied to the induction coil assembly 40 located at a lower portion of the water tank 20*a*, induction current is induced in the induction heating member 80 and thus the induction heating member 80 generates heat. As such, as the water in the steam generating part 29 is heated by thermal energy generated from the induction heating member 80, the water is converted to steam.

The induction heating member 80 is formed with small through-holes 81 such that bubbles generated between the bottom surface 21 of the water tank 20*a* and the induction heating member 80 can be discharged above the induction heating member 80 via the through-holes 81. The induction heating chamber 80 is further formed at respective corners with fitting grooves 82 having a substantially semi-circular shape such that the induction heating chamber 80 is easily fitted to or separated from the water tank 20*a*.

In order to allow the barrier 90 and the induction heating member 80 to be easily engaged with or disengaged from the water tank 20*a*, first supporting protrusions 32 are formed at opposite corners of the rear side 23 of the water tank 20*a*, and second supporting protrusions 33 are formed at opposite corners of the front side 22 thereof.

The first supporting protrusions 32 protrude from the rear side 23 while extending from the bottom surface of the water tank 20*a* to a height above the steam discharging hole 27. Each of the first supporting protrusions 32 has the same shape as that of the fitting groove 82 of the induction heating member 80, and has a cross-sectional area slightly smaller than the fitting groove 82.

The second supporting protrusions 33 protrude from the rear side 23 while slightly extending from the bottom surface of the water tank 20*a*. As with the first supporting protrusions 32, each of the supporting second protrusions 33 has the same shape as that of the fitting groove 82 of the induction heating member 80, and has a cross-sectional area slightly smaller than the fitting groove 82.

The first and second supporting protrusions 32 and 33 are respectively formed at lower ends thereof with flanges 32*a* and 33*a*, which extend outwardly such that the lower ends of the first and second supporting protrusions 32 and 33 have greater cross-sectional areas than the fitting grooves 82 of the induction heating member 80, so that the induction heating member 80 can be supported on the flanges 32*a* and 33*a*.

As in the first embodiment, the induction heating member 80 is made of a highly conductive metallic material, and the barrier 90 is made of a non-metallic material having low conductivity and good thermal resistance. Accordingly, heat emitted from the induction heating member 80 is efficiently transferred to a small amount of water under the barrier 60, so that steam is rapidly generated.

In order to allow the small amount of water to be given sufficient thermal energy by the induction heating member 80, the distance between the horizontal section 91 of the barrier 90 and the bottom surface 21 of the water tank 20*a* may be as narrow as possible to allow only a small amount of water to be received in the steam generating part 29.

Although it is suggested that a distance between the barrier 90 and the induction heating member 80, a distance between the induction heating member 80 and the bottom surface 21 of the water tank 20*a*, a diameter of the through-holes 81 of the induction heating member 80, and a diameter of the communication holes 93 of the barrier 90 be defined as small as possible, these distances and diameters preferably have sizes greater than 5~10 mm in order to allow the bubbles to escape therethrough.

The cover 70 is made from a material which enables the cover 70 to be easily coupled to or separated from the open upper portion of the water tank 20*a* while closing the upper portion of the water tank 20*a*. Thus, when the cover 70 is fitted to the upper portion of the water tank 20*s*, steam is prevented from being leaked through an edge of the cover 70 and the water tank 20*a*. The cover 70 can be easily separated from the water tank 20*a* by pulling the cover 70 up.

Accordingly, after fitting the fitting grooves 82 of the induction heating member 80 to the first and second supporting protrusions 32 and 33, the induction heating member 80 is pushed downward until the induction heating member 80 is laid, and horizontally supported on the respective flanges 32*a* and 33*a* of the first and second supporting protrusions 32 and 33. In this state, when the barrier 90 is fitted to the water tank 20*a*, a leading end of the horizontal section 91 of the barrier 90 is laid and supported on the second supporting protrusions 33, and the upper end 92*a* of the slanted section 92 is laid and supported on the first supporting protrusions 32. Subsequently, the cover 70 is coupled to the upper portion of the water tank 20*a*, so that the induction heating member 80 and the barrier 90 are assembled to the water tank 20*a* while allowing easy separation thereof from the water tank 20*a*.

When the water tank 20*a* having the induction heating member 80 and the barrier 90 coupled thereto is pushed into the cavity 3 of the oven 1 in which the induction coil assembly 40 is installed along with the supporting member 45 supporting the induction coil assembly 40, opposite sides of the bottom surface 21 of the water tank 20*a* are guided along the guide rails 47 of the supporting member 45, and slid inside the cavity 3.

When the water tank 20*a* is inserted in the cavity 3, the steam discharging pipe 27 extending outwardly from the rear side 23 of the water tank 20*a* is fitted to an entrance of a steam supplying pipe 8 positioned at the rear side of the cavity 3, so that the steam generating apparatus 10*a* is conveniently installed in the oven 1.

When electric current is applied to the induction coil assembly 40 after the steam generating apparatus 10*a* is finally assembled to the oven, induction current is induced in the induction heating member 80 by virtue of electromagnetic induction, and thus the induction heating member 80 generates heat, so that water in the steam generating part 29 is heated, and converted into steam.

Figure 10:
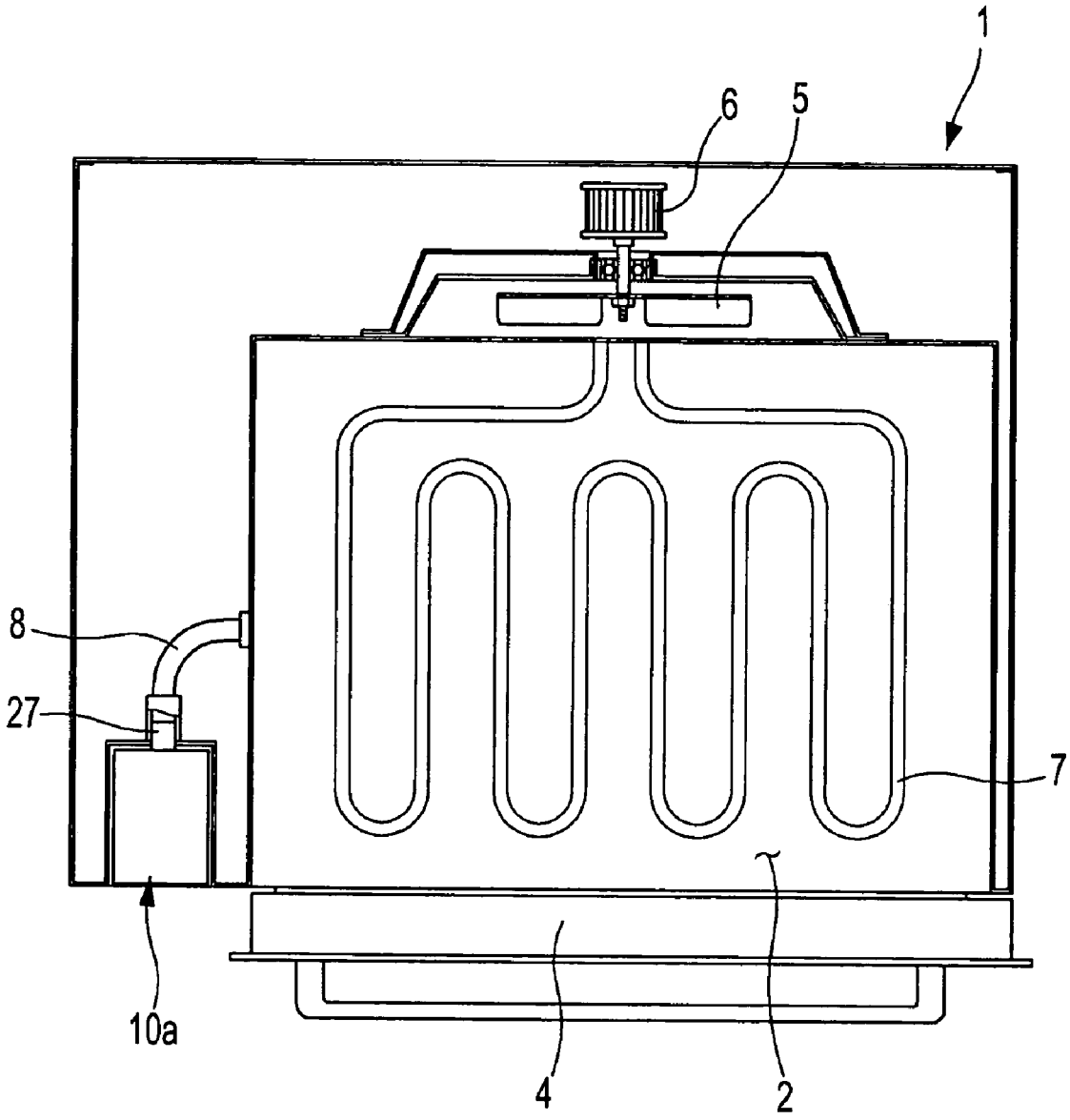
FIG. 10 is a cross-sectional view taken along line IX-IX of FIG. 9.

The steam generated from the steam generating part 29 is raised to the upper portion of the water tank 20*a* with guidance of the slanted section 92 of the barrier 90, discharged through the steam discharging pipe 27, and finally supplied to the cooking compartment 2 of the oven 1 through the steam supplying pipe 8 (see FIG. 10).

If scale is created inside the water tank 20*a* due to long term use of the steam generating apparatus 10*a*, the water tank 20*a* can be cleaned after disassembling the barrier 90 and the induction heating member 80 from the water tank 20*a*, so that the scale can be conveniently removed from the water tank 20*a*.

Operation of the steam generating apparatus 10*a* according to the second embodiment installed in the oven 1 will be described in detail with reference to FIGS. 9 and 10.

Figure 9:
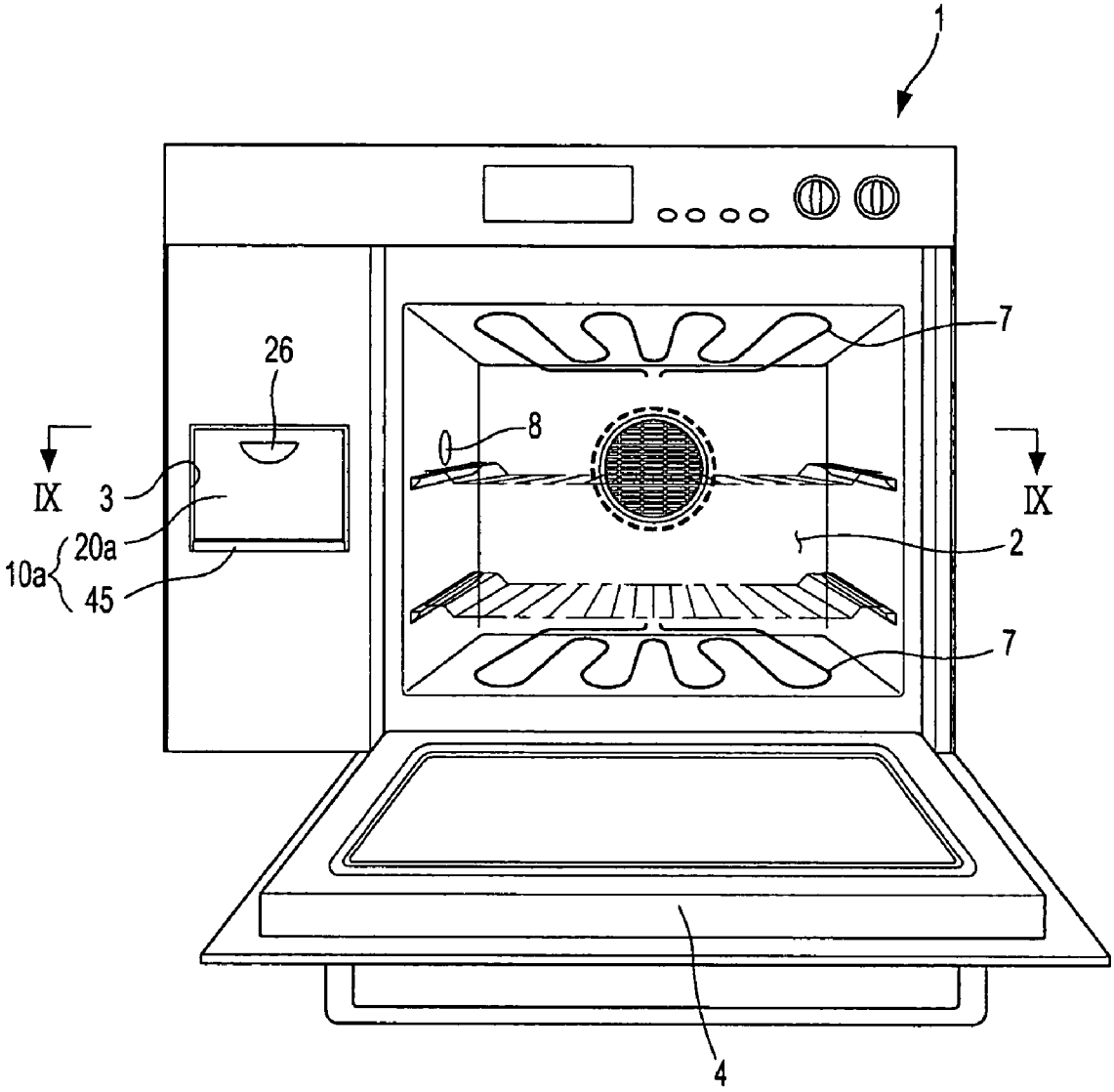
FIG. 9 is a front view illustrating an oven having the steam generating apparatus in accordance with the second embodiment of the present invention.

FIG. 9 is a front view illustrating an oven having the steam generating apparatus in accordance with the second embodiment of the present invention, and FIG. 10 is a cross-sectional view taken along line IX-IX of FIG. 9.

As shown in FIGS. 9 and 10, the oven 1 includes the cooking compartment 2 opened at a front side, the cavity 3 partitioned from the cooking compartment 2, and a door 4 attached to the front side of the cooking compartment 2.

The cavity 3 is installed with the steam generating apparatus 10*a* by inserting the steam generating apparatus 10*a* thereinto, and the cooking compartment 2 is provided at a rear side with a convection fan 5 and a fan motor 6 to circulate hot air and steam such that the hot air and the steam are distributed in an overall space of the cooking compartment 2.

The cooking compartment 2 is provided with electric heaters 7 on top and bottom surfaces to prevent the steam from being condensed on the top and bottom surfaces of the cooking compartment 2 while heating the steam supplied from the steam generating apparatus 10*a* and interior air in the cooking compartment 2 to high temperatures.

The steam generating apparatus 10*a* is installed in the cavity 3 by fixing the base plate 46 of the supporting member 45 to the bottom surface of the cavity 3 such that the induction coil assembly 40 is fixed to the cavity 3, and then sliding the water tank 20*a* into the cavity 3 along the pair of guide rails 47 of the supporting member 45.

Meanwhile, when pulling the handle 26 in a state that the water tank 20*a* is inserted in the cavity 3, the water tank 20*a* can be conveniently pulled out of the cavity 3, and then cleaned as described above or filled with water.

When the water tank 20*a* is coupled to the cavity 3, the steam discharging pipe 27 of the water tank 20*a* is automatically fitted to the steam supplying pipe 8 which extends from the rear side of the cavity 3 to a left side of the cooking compartment 2. In this state, as the steam generating apparatus 10*a* is operated, steam generated in the water tank 20*a* is supplied to the cooking compartment 2 through the steam discharging pipe 27 and the steam supplying pipe 8.

The steam supplied to the cooking compartment 2 is increased in temperature, and distributed in the overall space of the cooking compartment 2 by operation of the convection fan 5 and the electric heater 7, so that food is cooked by the steam.

As apparent from the above description, since the steam generating apparatus of the present invention, and the oven including the same have the structure wherein only a small amount of water partitioned by the barrier in the water tank is heated by the induction heating member adapted to generate heat via the induction coil assembly, steam can be rapidly generated, so that food is rapidly cooked in the oven with an enhanced energy efficiency.

In addition, in the steam generating apparatus of the invention and the oven including the same, since the water tank is easily coupled to or separated from the cavity, and the induction heating member and the barrier are easily engaged with or disengaged from the water tank, the water tank can be rapidly and satisfactorily cleaned, thereby ensuring hygienic cooking.

Although a few embodiments of the present invention have been shown and described, it would be appreciated by those skilled in the art that various modifications, additions and substitutions may be made in these embodiments without departing from the principle and spirit of the invention, the scope of which defined in the claims and their equivalents.

What is claimed is:

1. A steam generating apparatus, including;

a water tank opened at an upper portion;

a cover closing the upper portion of the water tank;

a barrier positioned inside the water tank to partition an interior of the water tank into a water supplying part and a steam generating part;

at least one induction coil assembly positioned outside the water tank; and an induction heating member positioned between the barrier and the induction coil assembly within the water tank, and induction-heated by the induction coil assembly to allow the steam generating part to generate steam, wherein the induction coil assembly is positioned at an outer portion of one side of the water tank, the barrier is positioned vertically adjacent the induction coil assembly such that the steam generating part has a much smaller volume than the water supplying part, the induction heating member is vertically positioned between the one side of the water tank and the barrier, the barrier has a lower end abutting a bottom surface of the water tank, and an upper end separated a predetermined distance from a top surface of the water tank, the water tank being formed at the top surface with a steam discharging pipe through which the steam generated from the steam generating part is discharged, and the lower end of the barrier is formed with at least one communication hole through which water is supplemented from the water supplying part to the steam generating part as the steam is generated in the steam generating part.

2. The apparatus according to claim 1, further comprising a supporting member to fix the induction coil assembly.

3. The apparatus according to claim 2, wherein the at least one induction coil assembly includes a plurality of induction coil assemblies positioned up and down on the supporting member.

4. The apparatus according to claim 1, wherein the induction coil assembly and the induction heating member have profiles extending from the bottom surface to an intermediate portion of the water tank, respectively.

5. The apparatus according to claim 1, wherein the barrier is positioned inside the water tank to be approximately 5 ~10 mm from a side of the water tank.

6. A steam generating apparatus, including:

a water tank opened at an upper portion;

a cover closing the upper portion of the water tank;

a barrier positioned inside the water tank to partition an interior of the water tank into a water supplying part and a steam generating part;

at least one induction coil assembly positioned outside the water tank; and an induction heating member positioned between the barrier and the induction coil assembly within the water tank, and induction-heated by the induction coil assembly to allow the steam generating part to generate steam, wherein the induction coil assembly is positioned at an outer portion of one side of the water tank, the barrier is positioned vertically adjacent the induction coil assembly such that the steam generating part has a much smaller volume than the water supplying part, the induction heating member is vertically positioned between the one side of the water tank and the barrier, the barrier is made from a material having a low conductivity, and the water tank has first guide grooves formed on front and rear sides thereof such that opposite ends of the barrier are slid along the first guide grooves, and engaged with or disengaged from the water tank.

7. The apparatus according to claim 6 wherein:

the induction heating member is made from a material having a higher conductivity, and the water tank has second guide grooves formed inside the first guide grooves on the front and rear sides thereof, respectively, such that opposite ends of the induction heating member are slid along the second guide grooves, and engaged with or disengaged from the water tank.

8. A steam generating apparatus, including:

a water tank opened at an upper portion;

a cover closing the upper portion of the water tank;

a barrier positioned inside the water tank to partition an interior of the water tank into a water supplying part and a steam generating part;

at least one induction coil assembly positioned outside the water tank; and an induction heating member positioned between the barrier and the induction coil assembly within the water tank, and induction-heated by the induction coil assembly to allow the steam generating part to generate steam, wherein the induction coil assembly is positioned at an outer portion of a bottom surface of the water tank, the barrier is positioned horizontally on the bottom surface of the water tank while being adjacent to the induction coil assembly such that the steam generating part has a much smaller volume than the water supplying part, the induction heating member is horizontally positioned between the bottom surface of the water tank and the barrier, and the water tank is provided at an upper portion with a steam discharging pipe, and the barrier includes a horizontal section extending in parallel with the bottom surface of the water tank, and a slanted section extending from the horizontal section towards the steam discharging pipe.

9. The apparatus according to claim 8, wherein the horizontal section is formed with a plurality of through-holes through which water is supplied from the water supplying part to the steam generating part to supplement reduction of water in the steam generating part as the water is converted to steam in the steam generating part.

10. The apparatus according to claim 9 wherein the plurality of through-holes have a diameter of about 5 mm.

11. The apparatus according to claim 8, wherein the barrier and the induction heating member are supported by supporting protrusions positioned at respective corners of the water tank.

12. An oven, including:

a cooking compartment;

a cavity partitioned from the cooking compartment;

a steam generating apparatus inserted in the cavity; and a steam supplying pipe connecting a rear portion of the cavity with a side of the cooking compartment, wherein the steam generating apparatus includes:

a water tank opened at an upper portion; a cover closing the upper portion of the water tank;

a barrier positioned inside the water tank to partition an interior of the water tank into a water supplying part and a steam generating part; and at least one induction coil assembly positioned outside the water tank; and an induction heating member positioned between the barrier and the induction coil assembly within the water tank, and induction-heated by the induction coil assembly to allow the steam generating part to generate steam, the water tank being provided at a rear upper portion thereof with a steam discharging pipe to which the steam supplying pipe is inserted to supply steam to the cooking compartment through the steam discharging pipe, wherein the induction coil assembly is positioned at an outer portion of one side of the water tank, the barrier is positioned vertically adjacent the induction coil assembly such that the steam generating part has a much smaller volume than the water supplying part, the induction heating member is vertically positioned between the one side of the water tank and the barrier, the barrier has a lower end abutting a bottom surface of the water tank, and an upper end separated a predetermined distance from a top surface of the water tank, the water tank being formed at the top surface with a steam discharging pipe through which the steam generated from the steam generating part is discharged, and the lower end of the barrier is formed with at least one communication hole through which water is supplemented from the water supplying part to the steam generating part as the steam is generated in the steam generating part.

13. The oven according to claim 12, wherein the water tank has a handle formed on a front side such that, when the water tank is pushed into the cavity using the handle, the steam discharging pipe is connected with the steam supplying pipe, allowing the water tank to be installed in the cavity, and such that, when the water tank is pulled out of the cavity using the handle, the steam discharging pipe is disengaged from the steam supplying pipe, allowing the water tank to be separated from the cavity.

* * * * *

UNITED STATES PATENT AND TRADEMARK OFFICE

CERTIFICATE OF CORRECTION

PATENT NO. : 7,326,891 B2
APPLICATION NO. : 11/385720
DATED : February 5, 2008
INVENTOR(S) : Han Jun Sung et al.

It is certified that error appears in the above-identified patent and that said Letters Patent is hereby corrected as shown below:

Column 1, Line 1 (Title), change “GENERATION” to --GENERATING--.

First Page, Column 2 (Title), Line 1, change “GENERATION” to --GENERATING--.

Column 12, Line 42, change “including;” to --including:--.

Signed and Sealed this

Twenty-sixth Day of August, 2008

JON W. DUDAS
*Director of the United States Patent and Trademark Office*